US008943935B2

(12) United States Patent
Qian

(10) Patent No.: US 8,943,935 B2
(45) Date of Patent: Feb. 3, 2015

(54) METHOD AND APPARATUS FOR KNIFE

(71) Applicant: Jonathan W. Qian, Villanova, PA (US)

(72) Inventor: Jonathan W. Qian, Villanova, PA (US)

(73) Assignee: Master Cutlery Inc., Secaucus, NJ (US)

( * ) Notice: Subject to any disclaimer, the term of this patent is extended or adjusted under 35 U.S.C. 154(b) by 151 days.

(21) Appl. No.: 13/791,944

(22) Filed: Mar. 9, 2013

(65) Prior Publication Data

US 2014/0251098 A1 Sep. 11, 2014

(51) Int. Cl.
*B26B 3/00* (2006.01)
*B26B 9/00* (2006.01)
*B26B 29/02* (2006.01)

(52) U.S. Cl.
CPC ... *B26B 3/00* (2013.01); *B26B 9/00* (2013.01); *B26B 29/02* (2013.01)
USPC ..... 83/13; 30/165

(58) Field of Classification Search
CPC ..... B26B 25/005
USPC ..... 30/295, 161, 344, 155, 165, 319, 340, 30/298, 287, 294, 314, 151, 317, 291; D7/649; D22/118
See application file for complete search history.

(56) References Cited

U.S. PATENT DOCUMENTS

| | | | | | |
|---|---|---|---|---|---|
| D57,935 | S | * | 5/1921 | Shively | D7/652 |
| 2,115,686 | A | * | 4/1938 | Zimmer | 30/295 |
| 2,153,759 | A | * | 4/1939 | Katzinger | 30/295 |
| 4,380,122 | A | * | 4/1983 | Jagger | 30/343 |
| 4,578,864 | A | * | 4/1986 | Hoffman | 30/295 |
| D362,485 | S | * | 9/1995 | Hall | D22/118 |
| D409,270 | S | * | 5/1999 | Balolia | D22/118 |
| D502,526 | S | * | 3/2005 | Rae | D22/118 |
| 8,283,854 | B2 | * | 10/2012 | Yokoyama et al. | 313/504 |

* cited by examiner

*Primary Examiner* — Ghassem Alie
(74) *Attorney, Agent, or Firm* — Walter J. Tencza, Jr.

(57) ABSTRACT

A knife including a blade section having a sharp edge, a J-shaped section, and a handle section connected to the J-shaped section. The J-shaped section may have a bottom portion connected to a stem portion, and a substantially uniform thickness. The sharp edge may have a thickness which is substantially less than the substantially uniform thickness of the J-shaped section. The handle section may have a thickness which is substantially greater than the uniform thickness of the J-shaped section. The blade section, the J-shaped section, and the handle section may be configured so that a person can place an index finger of the person so that an end of the index finger contacts the bottom portion of the J-shaped section and a length of the index finger contacts the stem portion of the J-shaped section, while simultaneously one or more further fingers of the person grip the handle section.

12 Claims, 6 Drawing Sheets

METHOD AND APPARATUS FOR KNIFE

FIELD OF THE INVENTION

This invention relates to improved methods and apparatus concerning knives.

BACKGROUND OF THE INVENTION

There are various knives known in the prior art.

SUMMARY OF THE INVENTION

In at least one embodiment, a knife is provided. The knife may include a blade section having a sharp edge, a J-shaped section adjacent the blade section, and a handle section connected to the J-shaped section. The J-shaped section may have a bottom portion connected to a stem portion. The J-shaped section may have a substantially uniform thickness. The sharp edge may have a thickness which is substantially less than the substantially uniform thickness of the J-shaped section. The handle section may have a thickness which is substantially greater than the uniform thickness of the J-shaped section.

The blade section, the J-shaped section, and the handle section may be configured so that a person can place an index finger of the person so that an end of the index finger contacts the bottom portion of the J-shaped section and a length of the index finger contacts the stem portion of the J-shaped section, while simultaneously one or more further fingers of the person grip the handle section.

The bottom portion of the J-shaped section may be substantially parallel to at least part of the sharp edge of the blade section. The bottom portion of the J-shaped section may be substantially perpendicular to the stem portion of the J-shaped section. The sharp edge of the blade section may curve from a first end where the sharp edge is substantially parallel to the bottom portion of the J-shaped section to an opposing second end where the sharp edge is substantially parallel to the stem portion of the J-shaped section.

The knife may be further comprised of an intermediate section connected between the blade section and the handle section. The intermediate section may have a curved surface. The J-shaped section may be on one side of the knife and the curved surface of the intermediate section may be on an opposing side of the knife. The curved surface of the intermediate section may have a substantially uniform thickness which is substantially greater than the thickness of the sharp edge. The curved surface of the intermediate section and the J-shaped section may be configured so that an end of an index finger of a person can contact the bottom portion of the J-shaped section while a further finger of the person contacts the curved surface of the intermediate section.

The bottom portion of the J-shaped section may be substantially perpendicular to the stem portion of the J-shaped section. The sharp edge of the blade section may curve from a first end where the sharp edge is substantially parallel to the bottom portion of the J-shaped section to an opposing second end where the sharp edge is substantially parallel to the stem portion of the J-shaped section.

The substantially uniform thickness of the J-shaped section may be about one eighth of an inch or greater. The thickness of the handle section may be about three times the thickness of the J-shaped section. The knife may be elongated, such that the knife has a length and a width, and the length is substantially greater than the width. The length may be about six and one half inches, and the width may be about one and one quarter inches.

A method is provided which includes using a knife to pare an outer covering off of an object using a sharp edge of the knife. The knife may have a structure as previously disclosed.

DETAILED DESCRIPTION OF THE DRAWINGS

Figure 1:
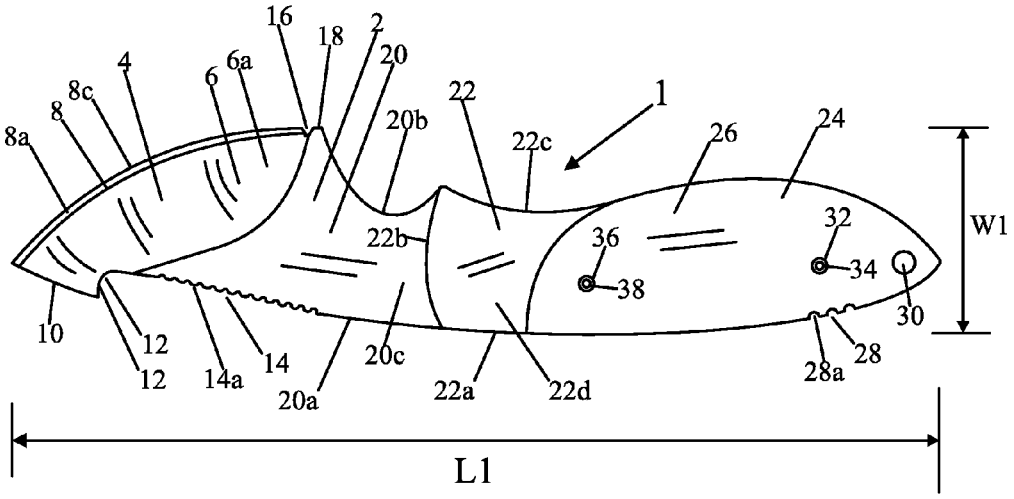
FIG. 1 shows a top view of a knife in accordance with an embodiment of the present invention.
Figure 2:
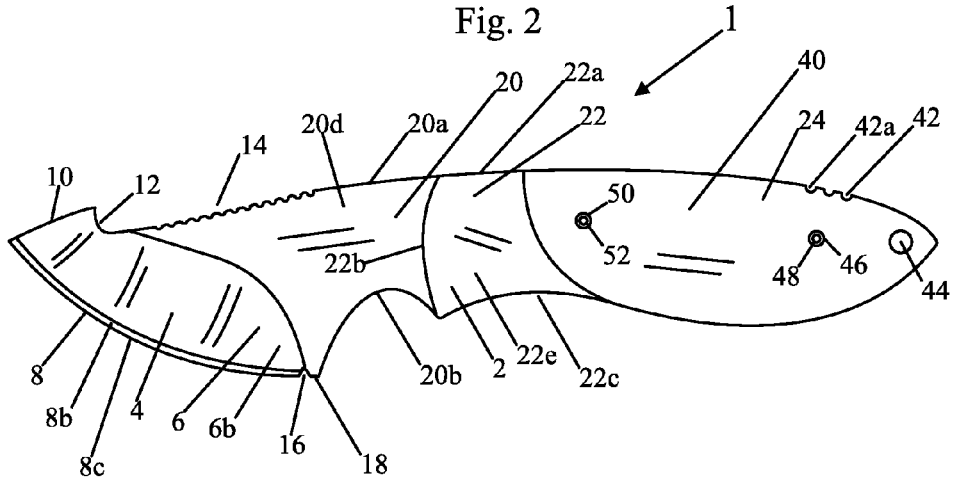
FIG. 2 shows a bottom view of the knife of FIG. 1.
Figure 3:
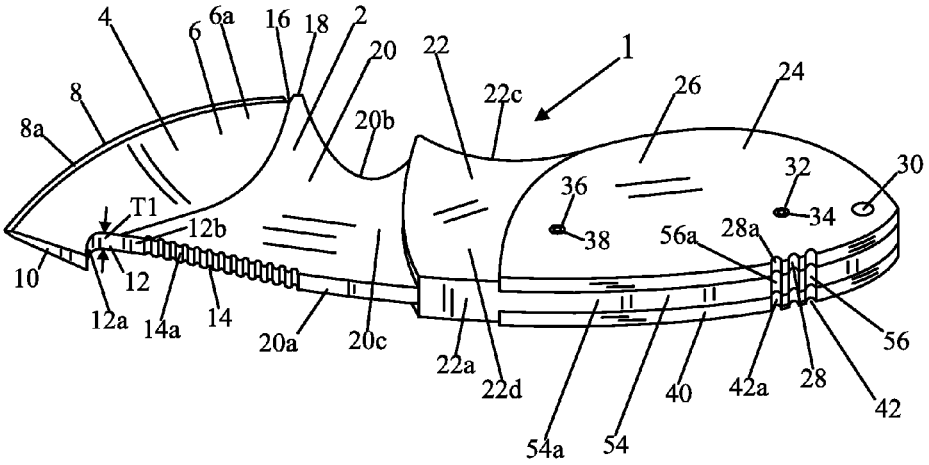
FIG. 3 shows a top, and front perspective view of the knife of FIG. 1.
Figure 4:
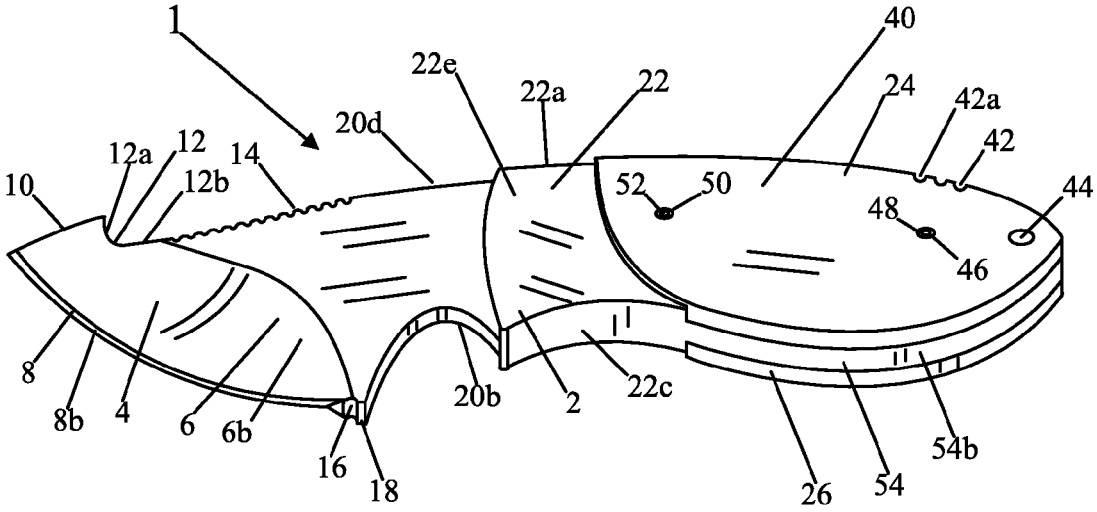
FIG. 4 shows a bottom, and rear perspective view of the knife of FIG. 1.
Figure 5:
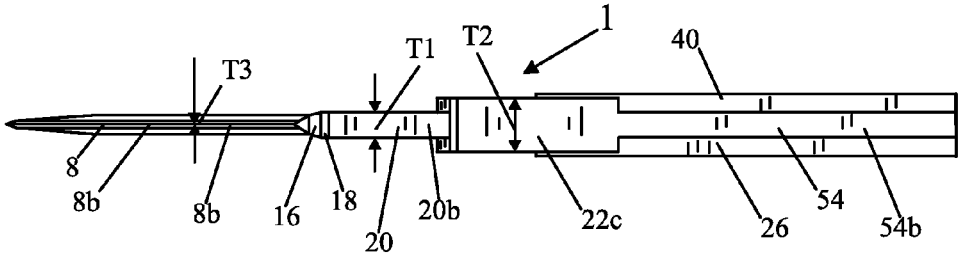
FIG. 5 shows a rear view of the knife of FIG. 1.
Figure 6:
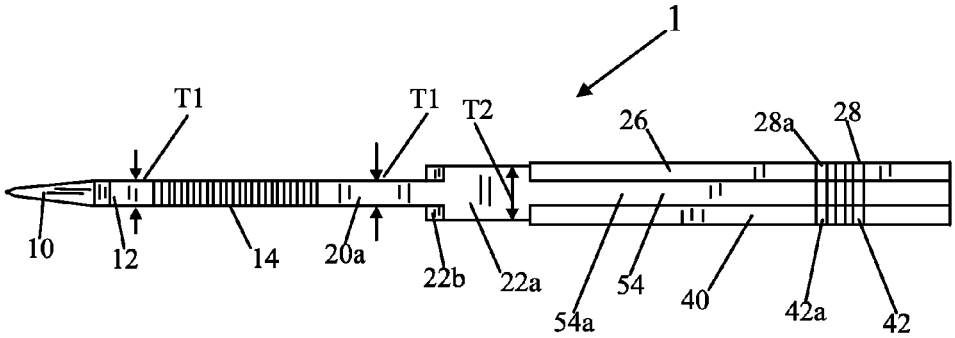
FIG. 6 shows a front view of the knife of FIG. 1.

FIG. 1 shows a top view of a knife 1 in accordance with an embodiment of the present invention. FIG. 2 shows a bottom view of the knife 1. FIG. 3 shows a top, and front perspective view of the knife 1. FIG. 4 shows a bottom, and rear perspective view of the knife 1. FIG. 5 shows a rear view of the knife 1. FIG. 6 shows a front view of the knife 1.

The knife 1 includes a body portion 2 and a handle device 24. The body portion 2 may be made of rigid metal such as steel. The handle device 24 may include handle portion 26 shown in FIG. 1 and handle portion 40 shown in FIG. 2. The handle portions 26 and 40 may be connected by screw or bolt 34 and 38 shown in FIG. 1 and fasteners or nuts 48 and 52, respectively, shown in FIG. 2. The screws or bolts 34 and 38 may be inserted through openings 32 and 36, and through openings 46 and 50 respectively, to connect and fix the handle portions 26 and 40 to the body portion 2. The handle portions 26 and 40 may be made of a rubber or plastic. There may be a hole 30 in handle portion 26 which is aligned with a hole 44 in handle portion 40, which is aligned with a hole, not shown, in section 54 of body portion 2. A lanyard can be inserted through the holes 30, and 44 to attach the knife 1 to a lanyard.

The body portion 2 includes a blade section 4, a section 20, and a section 22 shown in FIGS. 1 and 2, and a section 54 shown in FIGS. 3 and 4. The blade section 4 includes a gradually tapered section 6 having a top surface 6*a* shown in FIG. 1 and a bottom surface 6*b* shown in FIG. 2. The tapered section 6 gradually decreases from the section 20 to a blade edge section 8. The blade edge section 8 has a top surface 8*a* shown in FIG. 1, a bottom surface 8*b* shown in FIG. 2, and a blade edge 8*c* shown in FIGS. 1 and 2. The tapered section 6 and the blade edge section 8 form a triangular or substantially triangular surface 10 shown in FIG. 3 and FIG. 6. The blade edge 8*c* is typically very sharp and thus as thin as possible. The blade edge 8*c* has a thickness T3, shown in FIG. 5, which is typically much less than the thickness T1.

The section 20 has a uniform or substantially uniform thickness T1 shown in FIGS. 5 and 6. The section 20 includes a top surface 20*c*, shown in FIG. 1, a bottom surface 20*d* shown in FIG. 2, a front surface 20*a*, shown in FIG. 3, and a rear surface 20*b*, shown in FIG. 4. The front surface 20*a* includes a plurality 14 of ridges, including ridge 14*a*. An edge or surface 12 is shown between the plurality of ridges 14 and the surface 10. The edge or surface 12 may be J-shaped or L-shaped and may include a portion 12*a* and a portion 12*b*. The portion 12*a* may be the bottom section of the J or L shape, and the portion 12*b* may be the stem portion of the J or L shape. It is preferred and in at least one embodiment is critical that the J or L shape surface 12 have a uniform or substantially uniform thickness T1, as shown in FIG. 6, for reasons that will be explained later. The thickness T1 may be about one eighth of an inch. The thickness T1 may also be greater than one eighth of an inch. A thickness T1 of about one eighth of an inch or greater is critical in at least one embodiment so that a person's finger can rest comfortably without being cut or pinched.

The rear surface 20*b* of the section 20 is curved and on one side is next to a protrusion 18, which is next to an indentation 16. The protrusion 18 provides separation between the curved rear surface 20*b* and the sharp blade edge 8*c* to prevent a person from cutting a finger on the blade edge 8*c*. The curved rear surface 20*b*, and shown in FIG. 5, may have thickness T1, which may be about one eighth of an inch or greater than one eighth of an inch. In at least one embodiment, a thickness of about one eighth of an inch or greater is critical so that a person does not cut their finger using the knife 1.

The section 22 has a top surface 22*d*, shown in FIG. 1, a bottom surface 22*e*, shown in FIG. 2, a front surface 22*a*, shown in FIG. 3, and a rear surface 22*c* shown in FIG. 4. The section 22 has a thickness T2 which may be uniform or substantially uniform. The thickness T2 may be about three eighths of an inch or larger than three eighths of an inch. A thickness T2 of about three eighths of an inch or larger, in at least one embodiment, is critical to provide a comfortable location for gripping the section 22 of the knife 1 with two or more of an individual's fingers.

Section 54 of the body portion 2, is sandwiched between the handle portions 26 and 40, as shown in FIGS. 3 and 4. Section 54 includes an edge or surface 54*a* and an edge or surface 54*b*. Edge or surface 54*a* includes a plurality of indentations 56 which includes indentation 56*a*. The handle portion 26 includes a plurality of indentations 28 including indentation 28*a*, and the handle portion 40 includes a plurality of indentations 42, including the indentation 42*a*. The indentations 28, 56, and 42 are aligned with each other as shown in FIG. 3.

Figure 7:
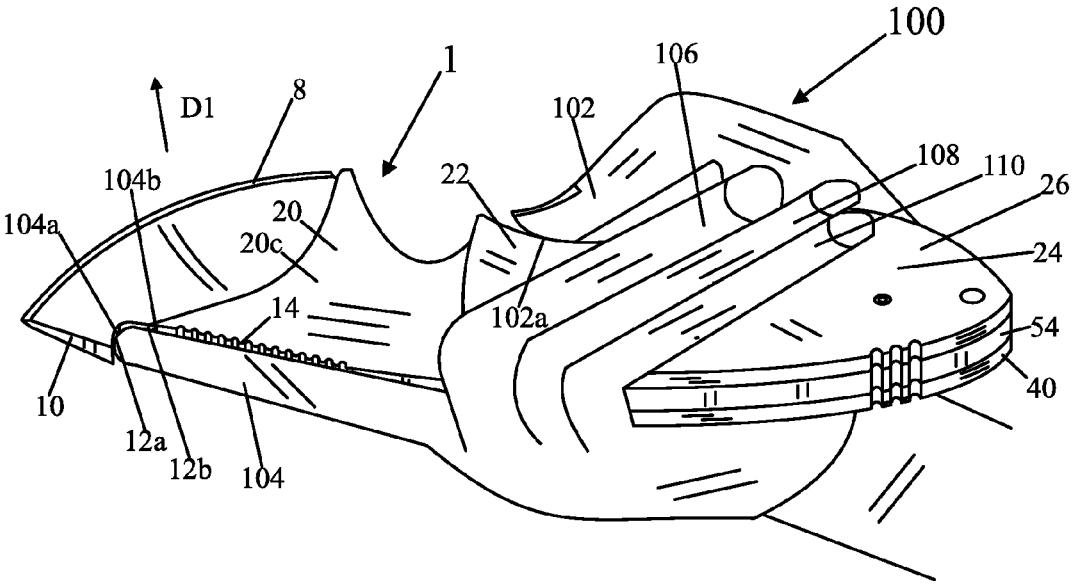
FIG. 7 shows a top, front perspective view of the knife of FIG. 1, with a person's hand holding the knife of FIG. 1.

FIG. 7 shows a top, front perspective view of the knife 1 of FIG. 1, with a person's hand 100 holding the knife 1. The person's hand 100 includes a thumb 102, an index finger or pointer finger 104, and fingers 106, 108, and 110. The index finger 104 has a portion 104*b* along its length or longest dimension, which rests on the ridges 14 and on the stem 12*b* of the J-shaped section 12. The index finger 104 has an end 104*a* which may contact bottom portion 12*a* of the J-shaped section 12. In at least one embodiment, it is critical that the bottom portion 12*a* be curved to match and/or fit the curve of the end 104*a* of the index finger 104 so that the index finger 104 can be comfortably held by the J-shaped bottom portion 12*a*. The ridges 14 help to provide a firm grip and/or to prevent the index finger 104 from sliding off of the section 20 and/or out of or off of the J-shaped section 12. An end 102*a* of the thumb 102 may rest on the section 22. The fingers 106, 108, and 110 may grip the combination of sections 22, 26, and 40.

In operation, a individual, while gripping the knife 1 as shown in FIG. 7 may cut an object by moving the blade section 8 in the direction D1 as shown in FIG. 7. Having the index finger 104 in the position shown in FIG. 7, allows the index finger 104 to provide pressure and stability, and to provide force in the direction D1 for better cutting. This is particularly useful for paring, such as when an individual wants to remove an outer covering or skin, such as the outer covering or skin of a piece of fruit.

Figure 8:
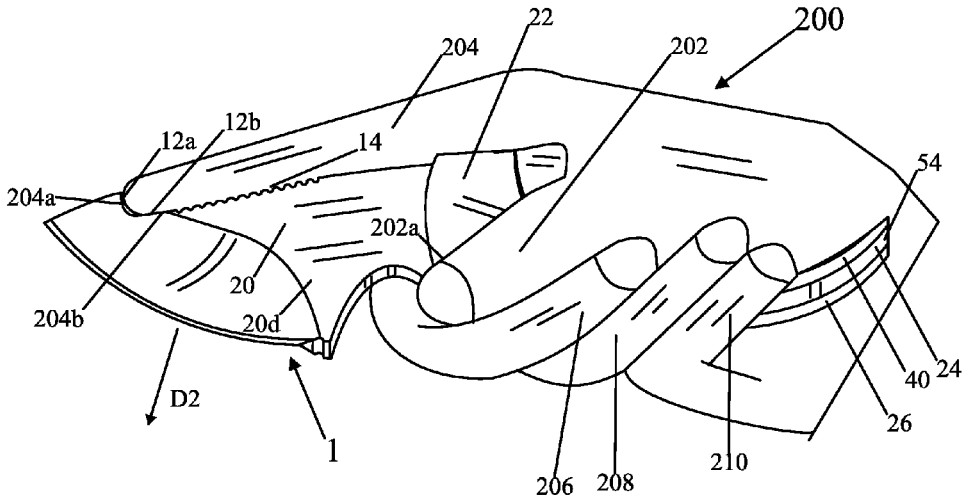
FIG. 8 shows a bottom, rear perspective view of the knife of FIG. 1, with a person's hand holding the knife of FIG. 1.

FIG. 8 shows a bottom, rear perspective view of the knife 1 of FIG. 1, with a person's hand 200 holding the knife 1. The configuration shown in FIG. 8 may be substantially the same as or the same as the configuration shown in FIG. 7, except shown from a different perspective. The hand 200 may be the same as the hand 100. In FIG. 8, the hand 200 includes a index finger 204, thumb 202, and fingers 206, 208, and 210. The index finger 204 has a portion 204*b* which rests on the portion 12*b* of J-shaped section 12 and on the ridges 14. The index finger 204 also has an end or tip 204*a* which contacts the bottom portion 12*a* of the J-shaped section 12. The thumb 202 has an end 202*a* which rests on the section 22 of the knife 1. The thumb 202 and the fingers 206, 208, and 210 grip the combination of the section 22 and the sections 26, 54, and 40.

In operation, referring to FIG. 8, the knife 1 can be moved in the direction D2 to cut an object. Having the index finger 204 in the position shown in FIG. 8, allows the index finger 204 to provide pressure and stability, and to provide force in the direction D2 for better cutting. This is particularly useful for paring, such as when an individual wants to remove an outer covering or skin, such as the outer covering or skin of a piece of fruit.

In at least one embodiment, the knife 1 is elongated and has a length of L1,which may be about six and one half inches or above. The knife 1 may have a width, W1, which may be about one inch and a quarter. In at least one embodiment, these dimensions are critical to provide a knife 1 cutting in the manner shown in FIG. 7 and FIG. 8, such as for paring skin off of fruit.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A method comprising using a knife to pare an outer covering off of an object using a sharp edge of the knife;

wherein the knife includes:

a blade section having a sharp edge;

a J-shaped section adjacent the blade section;

a handle section connected to the J-shaped section;

wherein the J-shaped section has a bottom portion connected to a stem portion;

wherein the J-shaped section has a substantially uniform thickness;

wherein the sharp edge has a thickness which is substantially less than the substantially uniform thickness of the J-shaped section;

wherein the handle section has a thickness which is substantially greater than the uniform thickness of the J-shaped section;

wherein the blade section, the J-shaped section, and the handle section are configured so that a person can place an index finger of the person so that an end of the index finger contacts the bottom portion of the J-shaped section and a length of the index finger contacts the stem portion of the J-shaped section, while simultaneously one or more further fingers of the person grip the handle section;

wherein the sharp edge of the blade section has a first end and a second end;

wherein the first end of the sharp edge of the blade section is further from the handle section than the second end of the sharp edge of the blade section;

wherein the bottom portion of the J-shaped section is closer to the first end of the sharp edge of the blade section than the second end of the sharp edge of the blade section;

wherein the bottom portion of the J-shaped section has a first end directly connected to the stem portion of the J-shaped section and a second end which is directly connected to a first end of a substantially straight surface; and wherein the substantially straight surface has an opposing second end which is directly connected to the first end of the sharp edge of the blade section.

2. The method of claim 1 wherein the bottom portion of the J-shaped section is substantially parallel to at least part of the sharp edge of the blade section.

3. The method of claim 1 wherein the bottom portion of the J-shaped section is substantially perpendicular to the stem portion of the J-shaped section; and the sharp edge of the blade section curves from a first end where the sharp edge is substantially parallel to the bottom portion of the J-shaped section to an opposing second end where the sharp edge is substantially parallel to the stem portion of the J-shaped section.

4. The method of claim 1 wherein the knife includes an intermediate section connected between the blade section and the handle section;

wherein the intermediate section has a curved surface;

wherein the J-shaped section is on one side of the knife and the curved surface of the intermediate section is on an opposing side of the knife;

wherein the curved surface of the intermediate section has a substantially uniform thickness which is substantially greater than the thickness of the sharp edge;

wherein the curved surface of the intermediate section and the J-shaped section are configured so that an end of an index finger of a person can contact the bottom portion of the J-shaped section while a further finger of the person contacts the curved surface of the intermediate section.

5. The method of claim 1 wherein the bottom portion of the J-shaped section is substantially perpendicular to the stem portion of the J-shaped section; and the sharp edge of the blade section curves from a first end where the sharp edge is substantially parallel to the bottom portion of the J-shaped section to an opposing second end where the sharp edge is substantially parallel to the stem portion of the J-shaped section.

6. The method claim 1 wherein the substantially uniform thickness of the J-shaped section is about one eighth of an inch or greater.

7. The method of claim 1 wherein the thickness of the handle section is about three times the thickness of the J-shaped section.

8. The method of claim 1 wherein the knife is elongated, such that the knife has a length and a width, and the length is substantially greater than the width;

and wherein the length is about six and one half inches, and the width is about one and one quarter inches.

9. The method of claim 1 further comprising applying force with the end of the index finger to the bottom portion of the J-shaped section without the end of the index finger being cut or pinched in order to use the knife to pare the outer covering off of the object using the sharp edge of the knife.

10. The method of claim 1 wherein the bottom portion of the J-shaped section is an indentation of the blade section opposite the sharp edge of the blade section.

11. The method of claim 1 further comprising using the index finger to apply force to the J-shaped section while the end of the index finger contacts the bottom portion of the J-shaped section and the length of the index finger is substantially straight in order to use the knife to pare the outer covering off of the object using the sharp edge of the knife.

12. The method of claim 9 further comprising using the index finger to apply force to the J-shaped section while the end of the index finger contacts the bottom portion of the J-shaped section and the length of the index finger is substantially straight in order to use the knife to pare the outer covering off of the object using the sharp edge of the knife.

* * * * *